United States Patent [19]

Robert et al.

[11] Patent Number: 4,791,217

[45] Date of Patent: Dec. 13, 1988

[54] SULPHUR DERIVATIVES OF PARA-METHOXYCINNAMIC ACID, PROCESSES FOR THEIR PRODUCTION, DERMO-PHARMACEUTICAL AND COSMETIC COMPOSITIONS CONTAINING THEM AND APPLICATIONS

[75] Inventors: Dominique D. Robert, Draguignan; Louis L. Jung, Strasbourg, both of France

[73] Assignee: Universite Louis Pasteur, Strasbourg Cedex, France

[21] Appl. No.: 862,495

[22] PCT Filed: Jun. 21, 1985

[86] PCT No.: PCT/FR85/00164

§ 371 Date: Apr. 9, 1986

§ 102(e) Date: Apr. 9, 1986

[87] PCT Pub. No.: WO86/00304

PCT Pub. Date: Jan. 16, 1986

[30] Foreign Application Priority Data

Jun. 22, 1984 [FR] France ..... 84 10008

[51] Int. Cl.[4] ..... C07C 69/76

[52] U.S. Cl. ..... 560/55

[58] Field of Search ..... 560/55

[56] References Cited

FOREIGN PATENT DOCUMENTS 2504530 10/1982 France ..... 560/74

*Primary Examiner*—Paul J. Killos

*Attorney, Agent, or Firm*—Browdy and Neimark

[57] ABSTRACT

Sulphur-containing derivatives of para-methoxycinnamic acid presenting a disulphur bridge and an amino-acid group, preparation process thereof.

Applications as active ingredients in dermo-pharmaceutical and cosmetological preparations wherein they exert an activity of solar filters which substantially do not penetrate in the circulatory stream.

11 Claims, No Drawings

SULPHUR DERIVATIVES OF PARA-METHOXYCINNAMIC ACID, PROCESSES FOR THEIR PRODUCTION, DERMO-PHARMACEUTICAL AND COSMETIC COMPOSITIONS CONTAINING THEM AND APPLICATIONS

The present invention relates to sulphur derivatives of para-methoxycinnamic acid not penetrating into the circulatory stream. They relate also to the production of said sulphur derivatives. The invention also relates to the cosmetological use, and the protection of the human skin against solar radiation; it relates also to the dermo-pharmaceutical and cosmetic compositions containing them.

The derivatives of para-methoxycinnamic acid correspond to the following formula I:

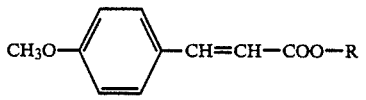

(I)

in which R represents non-sulfurized alkyl groups. These compounds are widely used as solar filters and contained in cosmetological compositions as active ingredient.

2-ethyl hexyl para-methoxycinnamate is the molecule which possesses to present one of the most selective filtering powers; it is very widely used in antisolar preparations in France and in the world. It is recognised by the FDA as corresponding to the necessary criteria for a selective sun screen. However D. Claus (Thèse de doctorat d'Université mention Pharmacie, 1982, Strasbourg) has been able to show that this sun filter penetrated into the blood after application to rabbit skin.

The present invention relates to sulphur derivatives of para-methoxycinnamic acid. The compounds of the invention correspond to the following general formula III:

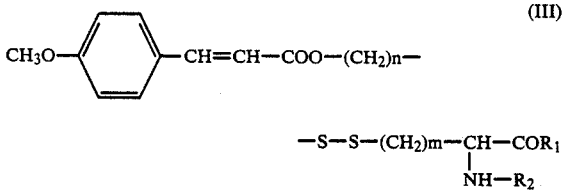

(III)

in which:

- the cinnamic double bond can exist either in the cis or in the trans form
- n is a whole number comprised between 1 and 6
- m is a whole number comprised between 1 and 6, and is preferably equal to 1 or 2
- $R_1$ is an —OR radical, R being a hydrogen atom or an alkyl or aryl group, R can also be an amino-alkyl or amino-aryl, or have an amino-acid structure giving a peptide linkage
- $R_2$ represents a hydrogen atom or alkyl or aryl group or a group of the formula R'—CO—, R' being an alkyl or aryl group or again R'—CO— having an amino-acid structure giving a peptide linkage.

In the present description, the term "alkyl" denotes aliphatic hydrocarbon groups containing 1 to 12 carbon atoms, with a straight or branched chain. Lower alkyl groups are preferred, that is to say alkyl groups containing 1 to 4 carbon atoms.

The term "aryl"denotes non heterocyclic-aromatic groups of the phenyl type, benzyl and higher homologues, substituted or not, as well as heterocyclic aromatic groups having 4 to 7 carbon atoms in the aromatic ring and 1 to 4 heteroatoms which can be oxygen, nitrogen, sulphur, furan type, pyridine, oxazole, as well as their saturated derivatives, respectively cyclohexane and tetrahydrofuran, piperidine, oxazolidine.

The present invention also relates to a process of synthesis of sulphur derivatives of para-methoxycinnamic acid with a disulfide bridge and with an amino-acid group, of the above formula III, which is characterized in that it consists of reacting a compound taken from the group which comprises sulphurized amino-acids and peptides having a free SH group, as well as their derivatives, with thio-2-ethanol para-methoxycinnamate of the following formula II:

$$CH_3O—C_6H_4—CH=CH—COO—CH_2—CH_2—SH \quad (II)$$

According to an advantageous method of practising the process according to the invention, thio-2-ethanol para-methoxycinnamate, of formula II, used to prepare the compounds of formula III according to the present invention is itself obtained by reacting, in the course of a first step, thionyl chloride on para-methoxycinnamic acid, to obtain the chloride of para-methoxycinnamic acid which is reacted, in the course of a second step, with dithio-2,2'-diethanol to obtain dithio-2,2'-diethanol bis-(para-methoxycinnamate) which corresponds to the following formula IV:

$$CH_3O—C_6H_4—CH=CH—COO—CH_2—CH_2—S—S—CH_2—CH_2—OCO—CH=CH—C_6H_4—OCH_3 \quad (IV)$$

which is reduced, in the course of a third step, into thio-2-ethanol para-methoxycinnamate of formula II.

It is also an object of the present invention to provide thio-2-ethanol para-methoxycinnamate of formula II, as an intermediate for the preparation of the compounds of formula III.

According to one method of practising the process of preparing the compound of formula III according to the present invention, the sulphurized amino acid used is cysteine or one of its higher homologues such as homocysteine, or a derivative of these amino acids.

According to another method of practising the process of preparing the compounds of formula III according to the present invention, the reaction of the amino acid or of the sulphurized protein with thio-2-ethanol para-methoxycinnamate of formula II is carried out in the presence of iodine in a suitable aqueous medium.

According to one method of practising the process of preparing thio-2-ethanol para-methoxycinnamate of formula II used as intermediate for the preparation of the compound of formula III, the reduction of the dithio-2,2'-diethanol bis-(paramethoxycinnamate) of formula IV into thio-2-ethanol para-methoxycinnamate of formula II is carried out by means of sodium borohydride, in a suitable aqueous medium.

The compounds of formula III according to the present invention possess interesting sun filter properties. They have a maximum efficiency both at the level of their ultra-violet adsorption capacity and at that of their fixation to the skin. Their adsorption spectrum is situated in the zone of erythematogenic U.V.B.s with a maximum towards 310 nm; they allow U.V.A. rays to pass.

It is also observed that the compounds of formula II used as intermediates for the preparation of the compounds of formula III also have sun screen properties.

An in-vivo study of the fixation of the sulphurized filters of formula III and II with the horny layer has been carried out on rabbit skin. No trace of para-methoxycinnamic acid, a metabolite of any solar filter of formulae III or II, has been detectable in the blood of the treated rabbits. The method of analysis by chromatography in the gaseous phase coupled with mass spectrometry enables concentrations of the order of 10 pg to be detected. It can therefore be concluded that these compounds do not penetrate into the circulatory stream, contrary to the ethyl-2-hexyl paramethoxycinnamate mentioned in the preamble.

The invention will now be described in more detail in the examples which follow, which have no limiting character.

EXAMPLE I

A. Synthesis of dithio-2,2' diethanol bis-(para-methoxycinnamate) of formula IV first step-synthesis of paramethoxycinnamic acid chloride in the presence of thionyl chloride.

Operational method:

In a flask provided with a cooling tube, 20 g of paramethoxycinnamic acid, 30 g of thionyl chloride and 200 ml of benzene are brought to boiling. After 8 h reflux, solvent is evaporated by means of a rotary evaporator. The thionyl chloride residue is removed in the same way by successive evaporations and taking up again in benzene.

second step: reaction of the acid chloride with dithio-2,2'-diethanol.

Operation method:

In a flask provided with a cooling tube, 20 g of paramethoxycinnamic acid chloride, 8 g of dithio-2,2-diethanol and 200 ml of benzene are brought to boiling. After 1 h reflux, the solvent is evaporated by means of a rotary evaporator. The ester obtained is purified by two successive recrystallizations in ethanol at 100°.

third step: synthesis of thio-2-ethanol para-methoxycinnamate of formula II.

In an Erlenmeyer flask, 1 g of compound IV is dissolved in a water-acetonitrile mixture (10:50); 1 g of $NaBH_4$ is added in fractions. After 30 minutes of stirring, 50 ml of an 0.1 molar $NH_4Cl$ solution are added. After filtration, the product obtained is dried The yield of compound II is of the order of 50%. Properties of the compound of formula II powder of melting point 98° C.

the U.V. absorption maximum is situated at 310 nm.

IR spectrum ($CHCl_3$): 1635 $cm^{-1}$ ($\nu c{=}c$); 1600 $cm^{-1}$ ($C_6H_4$); 1700 $cm^{-1}$ ($\nu$—co—o—)

NMR spectrum ($CDCl_3$): in ppm 1.55 (t, 2H, $CH_2$—S); 2.45 (t, 1H—SH); 3.72 (S, 3H, $OCH_3$); 4.40 (t, 2H, —$CH_2$—CO—); 6.25 (d, 1H, —CH—CO) and 7.65 (d, 1H, —CH—Ar): coupling 16 Hz (trans derivative); 6.82 (d, 2H) and 7.45 (d, 2H): coupling AA'BB' chromatographic constants: on a thin layer of Merck Silica gel 60F254 Rf=0.95 migration solvent: chloroform-ethyl acetate (50:50)

B. Synthesis of the compound of formula III, n=2, m=1, $R_2$=H and $R_1$=OH

In an Erlenmeyer flask, 2.7 g of compound II are stirred with 2.3 g of cysteinein the presence of 50 ml of acetonitrile and 10 ml of distilled water. 2.3 g of powdered iodine are added gradually still with stirring which is maintained between 2 and 3 hours. The separation of the compound III (n=2, m=1, R=H and R=OH) is done on a silica column, the elution solvent being, for example, a mixture of chloroform-methanol-benzene (10:5:20). Properties of the compound of formula III (n=2, m=1, $R_2$=H and $R_1$=OH)

yellowish powder with a melting point difficult to determine in view of the decomposition the U.V. absorption maximum is situated at 310 nm with the ninhydrin-based reagent the characteristic reaction of amino-acids is obtained the IR and NMR spectra give the characteristic bands of the para-methoxycinammic group already described for compound IV chromatographic constants: on a thin layer of Merck silica gel 60F254 Rf: 0.35, migration solvent: chloroform-methanol-benzene (10:5:20)

EXAMPLE II

Dermo-pharmaceutical composition containing a compound having solar filter properties according to the present invention The compound having solar filter properties, according to the present invention, is incorporated at the concentration 5% in an emulsion which may, for example, have the following composition:

| | |
|---|---|
| Paraffin | 12 g |
| PEG mono - and distearate (Tefose 1500) | 7 g |
| Stearic acid | 1 g |
| Cetyl alcohol | 0.5 g |
| Polyoxyethylene parmitostearic glyceride (Labrafil M 2130) | 3 g |
| Water q.s.p. | 100 g |

Method of investigating the para-methoxycinnamic acid (metabolite in the blood of the rabbit after application of sulfurized sun filters according to the invention incorporated in the preceding emulsion Conditions of application and plasma samplings 2 g of the emulsion to be tested are applied to the depilated skin of the rabbit. After making the deposit uniform by massage, 6 ml blood samples are taken at different times after the deposition. The measurements are carried out on the plasma fraction.

Quantitative determinations of CPG/SM

The solar filter having an ester function which is hydrolyzed by the blood esterases, the presence of the metabolite which is para-methoxycinnamic acid, was sought in the plasma fractions.

As an internal standard, the cinnamic acid which is added to the plasma was used. The latter acidified and then extracted by an acetone-methylene chloride mixture (1:3), the extracts were then injected after derivisation with BSTFA.

In all the extracts studied, the search for para-methoxycinnamic acid was shown to be negative. The sensitivity of the method enables up to 2 pg per injection to be detected.

Conclusion:

The sulfurized filter no longer passes into the blood whilst the PMCEH applied under the same conditions is found again therein in the form of para-methoxycinnamic acid at a concentration comprised between the ng and several μg's.

We claim:

1. Sulfurized derivatives of para-methoxycinnamic acid, characterized in that they correspond to the following general formula III:

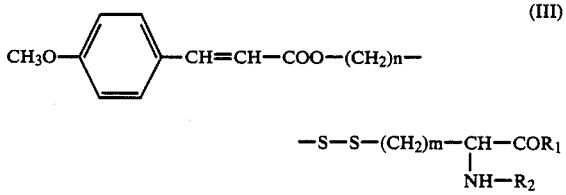

(III)

in which:

the cinnamic double bond can exist either in the cis form, or in the trans form n is a whole number comprised between 1 and 6 m is a whole number comprised between 1 and 6 and is preferably equal to 1 or 2

$R_1$ is a an OR radical, R being a hydrogen atom or an alkyl or aryl group, $R_1$ can also be an amino-alkyl or amino-aryl group or have an amino-acid structure giving a peptide linkage $R_2$ represents a hydrogen atom or an alkyl or an aryl group or a group of the formula R'—CO—, R' being an alkyl or aryl group or again R'—CO— having an amino-acid structure giving a peptide linkage.

2. Sulfurized derivative of para-methoxycinnamic acid according to claim 1, characterized in that it is the 2-amino-3[-2(p-methoxycinnamoyloxyethyl)disulfinyl]-propionic acid of above formula III.

3. Process for obtaining sulfurized derivatives of para-methoxycinnamic acid with disulfide bridge and with an amino-acid group, according to claim 1, characterized in that it consists of reacting a compound selected from the group consisting of sulfurized amino-acids and peptides having a free SH group, as well as their derivatives with thio-2-ethanol para-methoxycinnamate of formula II below:

$$CH_3O—C_6H_4—CH=CH—COO—CH_2—CH_2—SH$$

said compounds being in a molar ratio of 1.8:1.

4. Process for the preparation of thio-2-ethanol para-mythoxycinnamate of formula II employed in the process according to claim 3, characterized in that it is prepared by reacting, in the course of the first step, thionyl chloride on para-methoxycinnamic acid, these two compounds being in a molar ratio of 2.5:1.1, to obtain para-methoxycinnamic acid chloride which is reacted, in the course of a second step, in a molar ratio of 2:1, with dithio-2,2'-diethanol to obtain the dithio-2,2'-diethanol bis-(para-methoxycinnamate) which corresponds to the following formula IV:

$$CH_3O—C_6H_4—CH=CH—COO—CH_2—CH_2—S—S—CH_2—CH_2—OCO—CH=CH—C_6H_4—OCH_3$$

which is reduced, in the course of a third step, to thio-2-ethanol para-methoxycinnamate of formula II.

5. Process according to claim 3, characterized in that the sulfurized amino-acid used is cysteine or one of its higher homologues such as homocysteine, or a derivative of these amino-acids.

6. Process according to claim 3, characterized in the reaction of the amino-acid or of the sulfurized protein with the thio-2-ethanol para-methoxycinnamate of formula II is carried out in the presence of iodine in a suitable aqueous medium.

7. Process according to claim 4, characterized in the reduction of the dithio-2,2'-diethanol bis-(paramethoxycinnamate of formula IV to thio-2-ethanol para-methoxycinnamate of formula II is carried out by means of sodium borohydride at molar ratio 10:1 with respect to said paramethoxycinnamate of formula IV, in a suitable aqueous medium.

8. Dermopharmaceutical or cosmetological compositions characterized in that they contain, as active ingredient having solar filter properties with topical activity practically not penetrating into the circulatory stream, a compound of the general formula III according to claim 1 in combination with a suitable vehicle for application to the surface of the skin of man.

9. Process for obtaining sulfurized derivatives of para-methoxycinnamic acid with disulfide bridge and with an amino-acid group according to claim 2, characterized in that it consists of reacting a compound taken from the group which comprises sulfurized amino-acids and peptides having a free SH group, as well as their derivatives with thio-2-ethanol para-methoxycinnamate of formula II below:

$$CH_3O—C_6H_4—CH=CH—COO—CH_2—CH_2—SH \quad (II)$$

10. Process according to claim 5, characterized in the reaction of the amino-acid or of the sulfurized protein with the thio-2-ethanol para-methoxycinnamate of formula II is carried out in the presence of iodine in a suitable aqueous medium.

11. Dermopharmaceutical or cosmetological compositions characterized in that they contain, as active ingredient having solar filter properties with topical activity practically not penetrating into the circulatory stream, a compound of the general formula III according to claim 2, in combination with a suitable vehicle for application to the surface of the skin of man.

* * * * *